US009605930B2

(12) United States Patent
Ben Yair et al.

(10) Patent No.: US 9,605,930 B2
(45) Date of Patent: Mar. 28, 2017

(54) NON-LETHAL WEAPON FOR SELF-DEFENSE

(71) Applicant: H. D. Defense Products Ltd., Petach Tikva (IL)

(72) Inventors: Daniel Refael Ben Yair, Hod HaSharon (IL); Benny Hillman, Petach Tikva (IL)

(73) Assignee: H. D. DEFENSE PRODUCTS LTD., Petach Tikva (IL)

( * ) Notice: Subject to any disclaimer, the term of this patent is extended or adjusted under 35 U.S.C. 154(b) by 0 days.

(21) Appl. No.: 14/492,094

(22) Filed: Sep. 22, 2014

(65) Prior Publication Data

US 2015/0083749 A1 Mar. 26, 2015

Related U.S. Application Data

(60) Provisional application No. 61/881,458, filed on Sep. 24, 2013.

(51) Int. Cl.
*F41H 9/10* (2006.01)

(52) U.S. Cl.
CPC ..... *F41H 9/10* (2013.01)

(58) Field of Classification Search
CPC .. B65D 83/202; B65D 83/384; B65D 83/386; F41H 9/10
USPC ..... 222/79, 402.13, 183, 325, 162, 182, 222/153.01; 42/1.08
See application file for complete search history.

(56) References Cited

U.S. PATENT DOCUMENTS 2,629,516 A 2/1953 Badham
3,189,232 A * 6/1965 Joffe ..... B65D 83/202 222/394
3,439,839 A * 4/1969 Schumann ..... B05C 17/00516 222/183
3,575,318 A * 4/1971 Kunz ..... B05B 11/048 222/326
3,602,399 A * 8/1971 Litman et al. ..... 222/153.11
3,730,390 A * 5/1973 Adrian ..... F41H 9/10 222/402.13
3,841,526 A 10/1974 Haskins
(Continued)

FOREIGN PATENT DOCUMENTS

DE 1915045 3/1969
WO 2007117713 A2 10/2007

OTHER PUBLICATIONS

"Mace Pepper Spray Gun—Features and Customer Reviews", Carolyn, Aug. 9, 2013, FamilyHomeSecurity.com.

*Primary Examiner* — Charles P Cheyney
(74) *Attorney, Agent, or Firm* — Hanan Farber Patent Agent Ltd.

(57) ABSTRACT

Non-lethal weapon includes a housing, a barrel insertable into the housing and a barrel locking mechanism. The non-lethal weapon may be adapted for spraying a pepper extract onto a potential attacker in order to disable the potential attacker. The barrel is adapted to hold a canister of the pepper extract under pressure. The barrel may be rotatable to lock the barrel into the housing. A longitudinal axis of the barrel is angled upward at a substantial angle relative to the longitudinal axis of the housing or relative to the upper surface of the housing when the weapon is used. The non-lethal weapon includes a conical orifice adapted to spray the pepper extract over an opening angle of between 70 and 120 degrees.

9 Claims, 7 Drawing Sheets

(56) References Cited

U.S. PATENT DOCUMENTS

| | | | | |
|---|---|---|---|---|
| 4,223,804 | A * | 9/1980 | Morris et al. | 222/3 |
| 5,065,904 | A | 11/1991 | McCaffrey et al. | |
| 5,102,052 | A * | 4/1992 | Demarest | B05B 11/06 222/631 |
| 5,361,946 | A * | 11/1994 | Ginther | A23G 3/0242 222/175 |
| 5,397,029 | A | 3/1995 | West | |
| 5,629,679 | A * | 5/1997 | Cranford | F41H 9/10 200/519 |
| 5,671,559 | A * | 9/1997 | Ludaesher et al. | 42/1.08 |
| 5,934,569 | A * | 8/1999 | Soule | B05B 1/3436 239/468 |
| 6,196,419 | B1 * | 3/2001 | Haney et al. | 222/79 |
| 6,546,661 | B1 | 4/2003 | Staubs | |
| 7,264,143 | B2 * | 9/2007 | Khubani et al. | 222/325 |
| 7,644,839 | B2 * | 1/2010 | McNulty, Jr. | 222/79 |
| 7,743,950 | B2 | 6/2010 | Tsai | |
| 8,313,009 | B2 * | 11/2012 | Parisi et al. | 222/153.11 |
| 2006/0011662 | A1 | 1/2006 | Khubani et al. | |
| 2012/0118990 | A1 | 5/2012 | Beever, III | |

* cited by examiner

NON-LETHAL WEAPON FOR SELF-DEFENSE

CROSS REFERENCE TO RELATED APPLICATIONS

The present application claims priority from provisional patent application 61/881,458 filed 24 Sep. 2013 in the United States Patent and Trademark Office by the present inventor, the disclosure of which is incorporated herein by reference.

BACKGROUND

1. Technical Field

The present invention relates to non-lethal weapons and particular a non-lethal weapon adapted for spraying a pepper extract at a perpetrator as a self-defense act.

2. Description of Related Art

Pepper spray may be used by potentially vulnerable individuals in order to defend themselves when their safety is threatened by an attacker. An attacker with face sprayed by pepper spray may be neutralized for at least 10 minutes. There are generally no lasting effects from use of pepper spray and pepper spray is not generally fatal.

BRIEF SUMMARY

Various non-lethal weapons are provided for herein which include a housing, a barrel insertable into the housing and a barrel locking mechanism. The non-lethal weapon may be adapted for spraying a pepper extract onto a potential attacker in order to disable the potential attacker. The barrel may be adapted to hold a canister of the pepper extract under pressure. The barrel may be rotatable to lock the barrel into the housing. A longitudinal axis of the barrel may be angled upward at a substantial angle relative to the longitudinal axis of the housing or relative to the upper surface of the housing when the weapon is used. The non-lethal weapon may further include a conical orifice adapted to spray the pepper extract over an opening angle of between 70 and 120 degrees. The opening angle and the upward angle between the longitudinal axis of the barrel and the upper surface of the housing may limit the range of the non-lethal weapon to two meters. The non-lethal weapon may further include a trigger mechanism for spraying pepper extract and a safety mechanism which when engaged, enables the trigger mechanism and when released disables the trigger mechanism. The non-lethal weapon may include a safety guard which protrudes from the housing around the safety mechanism to prevent an accidental release of the safety mechanism.

The foregoing and/or other aspects will become apparent from the following detailed description when considered in conjunction with the accompanying drawing figures.

BRIEF DESCRIPTION OF THE DRAWINGS

The invention is herein described, by way of example only, with reference to the accompanying drawings, wherein.

Figure 1:
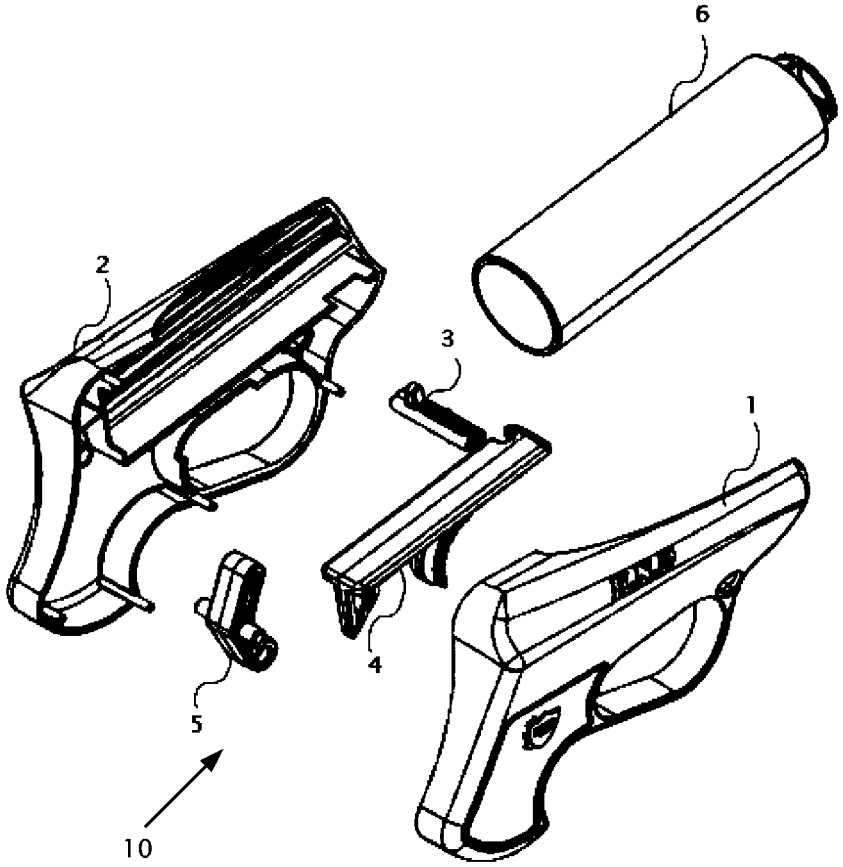
FIGS. 1 and 1A show an exploded view of the parts of a hand held non-lethal weapon and a perspective view of the hand held non-lethal weapon respectively.

The foregoing and/or other aspects will become apparent from the following detailed description when considered in conjunction with the accompanying drawing figures.

DETAILED DESCRIPTION

Reference will now be made in detail to features of the present invention, examples of which are illustrated in the accompanying drawings, wherein like reference numerals refer to like elements throughout. The features are described below to explain the present invention by referring to the figures.

Before explaining features of the invention in detail, it is to be understood that the invention is not limited in its application to the details of design and the arrangement of the components set forth in the following description or illustrated in the drawings. The invention is capable of other features or of being practiced or carried out in various ways. Also, it is to be understood that the phraseology and terminology employed herein is for the purpose of description and should not be regarded as limiting.

By way of introduction, various embodiments of the present invention are directed to a device, a non-lethal weapon adapted for spraying a pepper extract, onto a perpetrator as a self-defense act. The non-lethal weapon in different embodiments of the present invention may include a number of novel features over prior art and addresses a least the following common scenario:

The perpetrator or attacker is expected to choose a potential victim with smaller body measures then his own, relying on his larger size as a psychological barrier to the victim to resist the attack. On expecting an attack, the potential victim draws a weapon for spraying pepper spray extract according to an embodiment of the present invention. On close range, the attacker may resist being sprayed and hold the arm of the victim so that the weapon is not aimed toward his face. Prior art non-lethal pepper spray weapons may be optimized for maximum range and consequently have a narrow spray angle. Using such a prior art weapon for spraying pepper spray, the spray either misses the attacker's body or the spray hits him in the torso. A hit on the torso does not effectively neutralize the attacker. An effective neutralization of the attacker occurs when the attacker is hit in the face with pepper spray. A weapon according to embodiments of the present invention is adapted to spray upward and at a wide angle so that without aim or under restraint by the attacker less than one or two meters away, the attacker is still likely to receive spray in the face and be temporarily disabled.

The present invention in different embodiments includes features which prevent causing pepper spray to be discharged while the non-lethal weapon is being stored in a bag or pocket. A pepper spray canister includes a high pressure bottle containing the pepper spray extract. Dropping a pepper spray canister may damage the high pressure bottle causing pepper spray to be inadvertently discharged. In different embodiments, the present invention avoids accidental discharge of the spray and/or protects the canister from damage and/or accidental discharge as a result of being dropped or accidental pressing the safety catch.

Referring now to the drawings, reference is now made to FIG. 1 which shows, according to features of the present invention an exploded view of the parts of the hand held non-lethal weapon 10 and shows in simplification an assembly of the parts. The parts as shown in FIG. 1 are as follows: right housing 1, left housing 2, safety 3, trigger 4, hammer 5 and barrel 6.

The parts of weapon 10 may all be manufactured from plastic using standard manufacturing techniques such as casting any of a number of thermoplastic or thermoset resins such as polycarbonate or ABS (Acrylonitrile butadiene styrene). Right housing and left housing may include ribs as shown to add strength or stiffness.

During assembly of the non-lethal weapon, right housing 1 and left housing 2 may be snapped and glued together while avoiding additional fasteners or other metal parts. Assembly may be achieved using pins and corresponding holes integral to the casting in housings 1 and 2. The internal parts may include: safety 3, trigger 4 and hammer 5 inserted into appropriate slots and/or apertures in right and left housings. Subsequent to assembly, the canister including pepper spray is inserted by the user into barrel 6. Barrel 6 with the pepper spray canister is inserted and locked into housings 1 and 2 after assembly.

During operation, the user pushes safety 3 from the right position (locked) to the left position (unlocked) thereby unlocking and enabling trigger 4. When safety 3 is released, the user may pull trigger 4 which engages hammer 5. Hammer 5 then engages the canister which is pushed forward until the nozzle of the canister engages the orifice of barrel 6 to spray the pepper extract on the attacker's face in self-defense act.

Figure 1A:
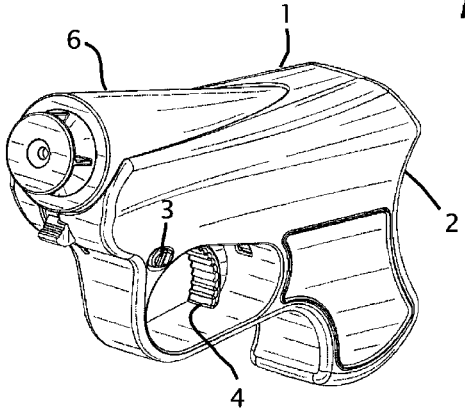
Figure 2:
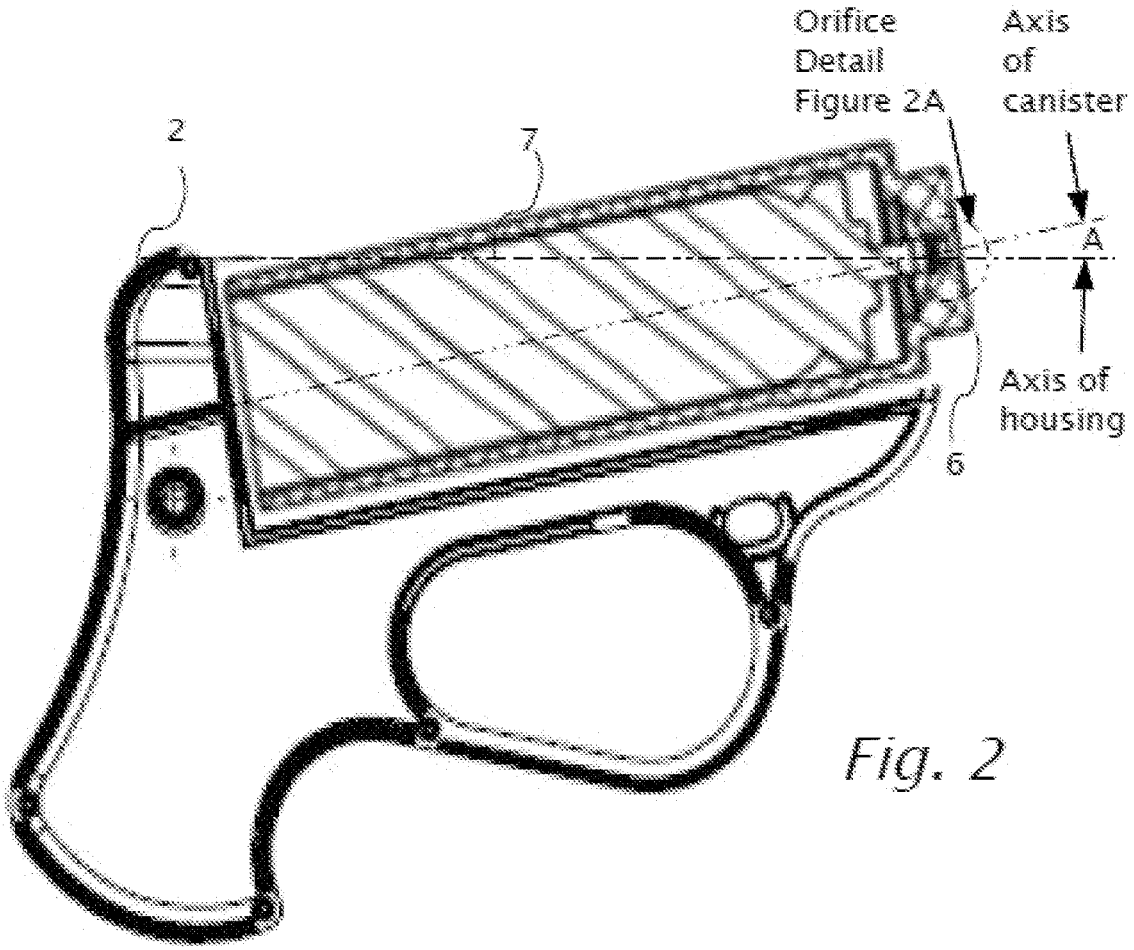
FIG. 2 illustrates the left housing and canister shown in cross section, according to a feature of the present invention.

Reference is now made to FIG. 1A which shows a perspective view of assembled weapon 10 which includes weapon housings 1,2 joined together. Reference is also made to FIG. 2, which illustrates right housing 2 and canister 7 containing pepper spray under pressure is shown in cross section, illustrating a feature of the present invention. The longitudinal axis of non-lethal weapon housings 1,2 is shown as a substantially horizontal line labeled "axis of housing". The longitudinal axis (labeled "axis of canister") of barrel 6 which holds canister 7 is angled upward at an angle "A" relative to the "axis of housing". Canister 7 is pointed upward by angle "A" relative to the "axis of housing".

The term "longitudinal axis" of a hand-held weapon is defined herein with respect to the housing typically by the upper surface of the housing when the weapon is used. The user of a prior art hand held weapon may hold the weapon at shoulder height and point the weapon horizontally by sighting to the target over the top of the weapon. In prior art weapons, the barrel is parallel to the longitudinal axis of the housing and the longitudinal axis of the weapon is the same as the axis of the barrel. The term "upward" refers to the normal use of the weapon in which the handle is downward. According to a feature of the present invention, if weapon 10 is held horizontally at shoulder height then the longitudinal axis of housings 1 and 2 may be horizontal and the axis of barrel 6 and canister 7 is at a substantial angle of 10-30 degrees pointing upward from the horizontal. The upward angle A of barrel 6 relative to housings 1 and 2 increases the chance of hitting the face of the attacker when in close range and/or when the user (potential victim) is being physically restrained by the attacker.

Figure 2A:
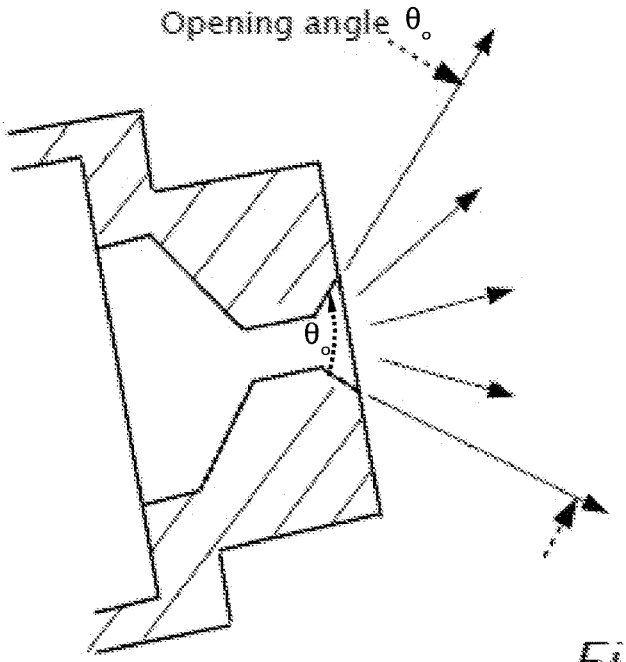
FIG. 2A shows a detail of the orifice of barrel, illustrating another feature of the present invention.

Reference is now also made to FIG. 2A which shows a detail of the orifice of barrel 6 as shown in FIG. 2, according to an embodiment of the present invention. The orifice of barrel 6 is designed so that when weapon 10 is used, the pepper extract spray exiting barrel 6 is conical with opening angle $\theta_0$ between 70 to 120 degrees. Opening angle $\theta_0$ of the spray may be between 80 and 110 degrees, or between 90 and 120 degrees.

The term "opening angle" as used herein refers to a right cone and the vertex angle $\theta_0$ is made by a cross section of the cone through the apex of the cone at orifice of barrel 6 and the center of the cone base. The cone base center is determined by the center of the spray.

Figure 3A:
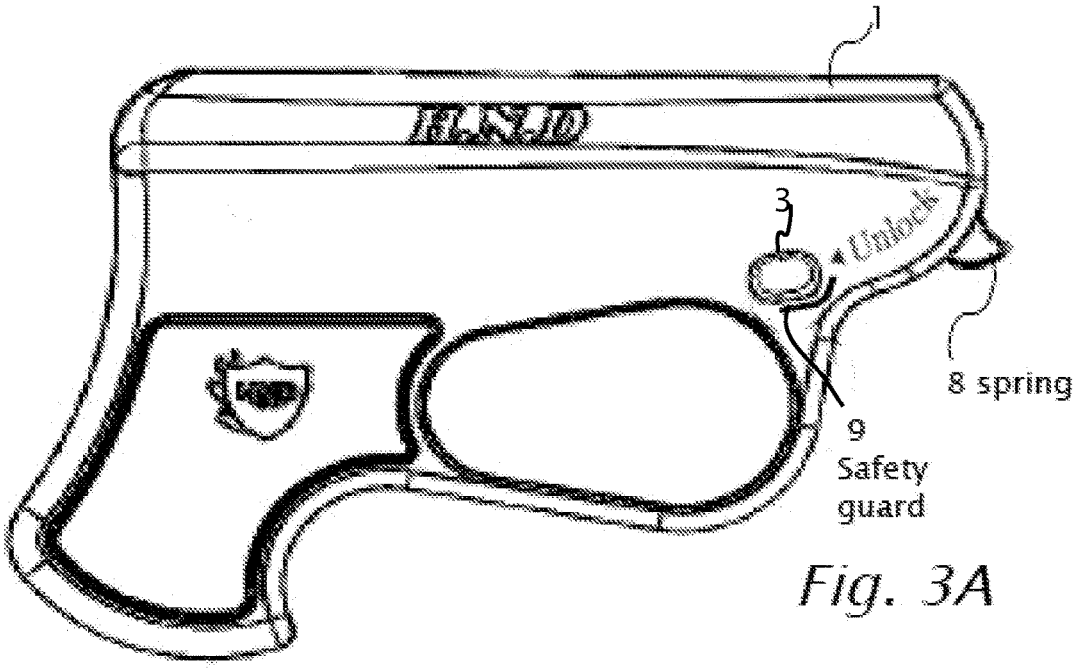
FIGS. 3A and 3B illustrate the right side view and bottom view respectively of a portion of the locking mechanism between the barrel and the housing of a non-lethal weapon according to a feature of the present invention.
Figure 3B:
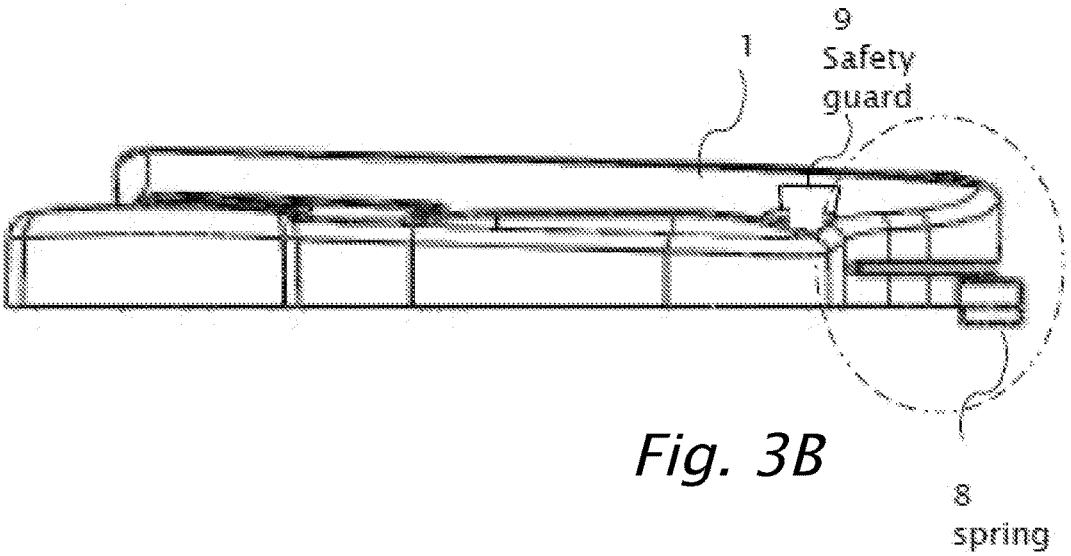

Reference is now made to FIGS. 3A and 3B which illustrate a side view and bottom view of housing 1 respectively of a portion of the barrel locking mechanism between barrel 6 and housing 1, according to a feature of the present invention. A lock spring 8 which may be formed integrally as part of casting of right housing 1 is shown. A safety guard 9 is shown which protrudes from the side of housing 1 and is intended to minimize or eliminate accidental releasing of safety 3 during operation.

Figure 3C:
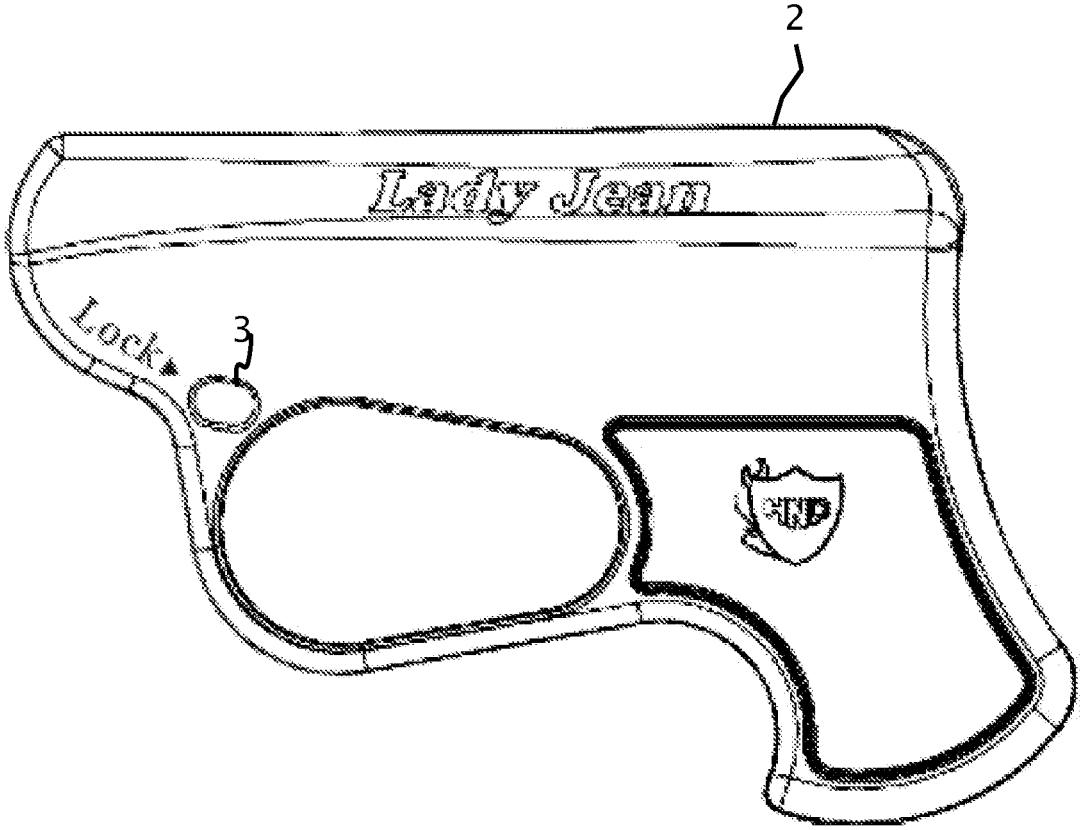
FIG. 3C illustrates side view of a housing, according to a feature of the present invention.

Reference is now made again to FIG. 3A and also to FIG. 3C which illustrate side views of housings 1 and 2, according to a feature of the present invention. With respect to housing 1 the word "Unlock" is shown pointing to the location of safety 3. The word "Unlock" and symbol (<) indicates to the user where to press safety 3 in to the left so that trigger 4 may be enabled to spray the pepper extract on the attacker's face in a self defense act. Similarly with respect to housing 2 in FIG. 3C, the word "Lock" is shown pointing to the location of safety 3. The word "Lock" and symbol (<) indicates to the user where to press safety 3 in to the right so that trigger 4 is prevented from being activated to spray the pepper extract. The words "Unlock" and "Lock" and symbols (<) may be formed as part of the casting of housings 1 and 2.

Figure 3D:
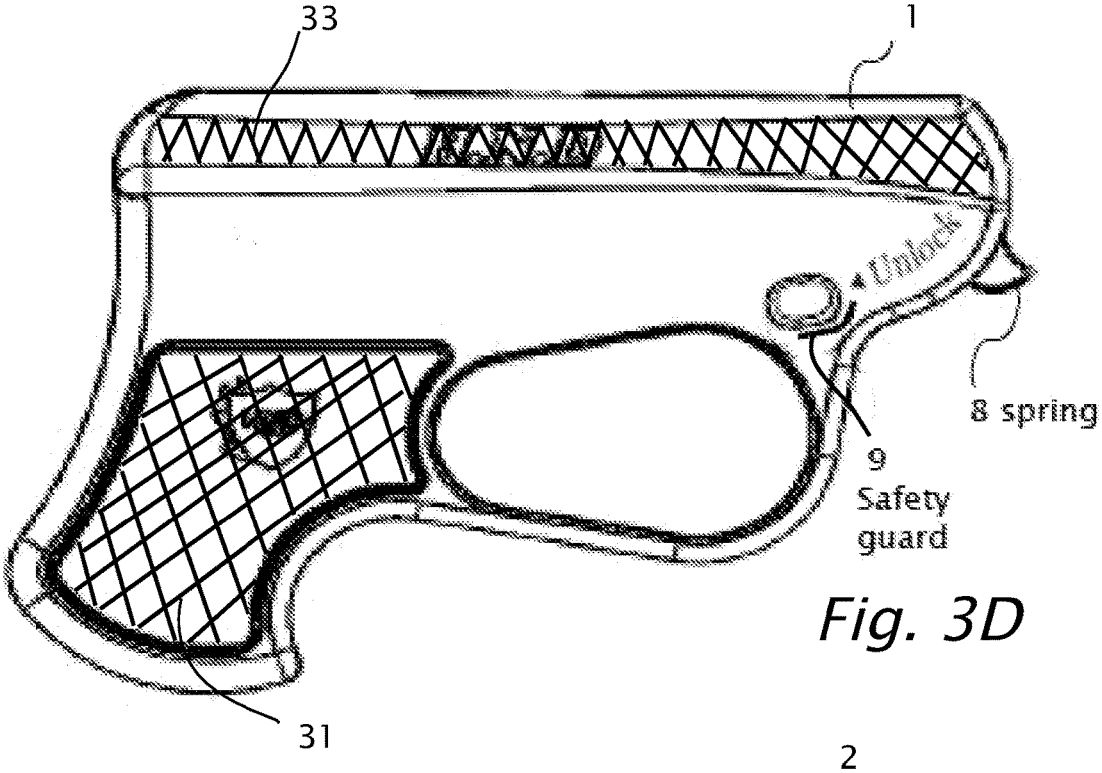
FIGS. 3D and 3E illustrate side views of housings, according to a feature of the present invention
Figure 3E:
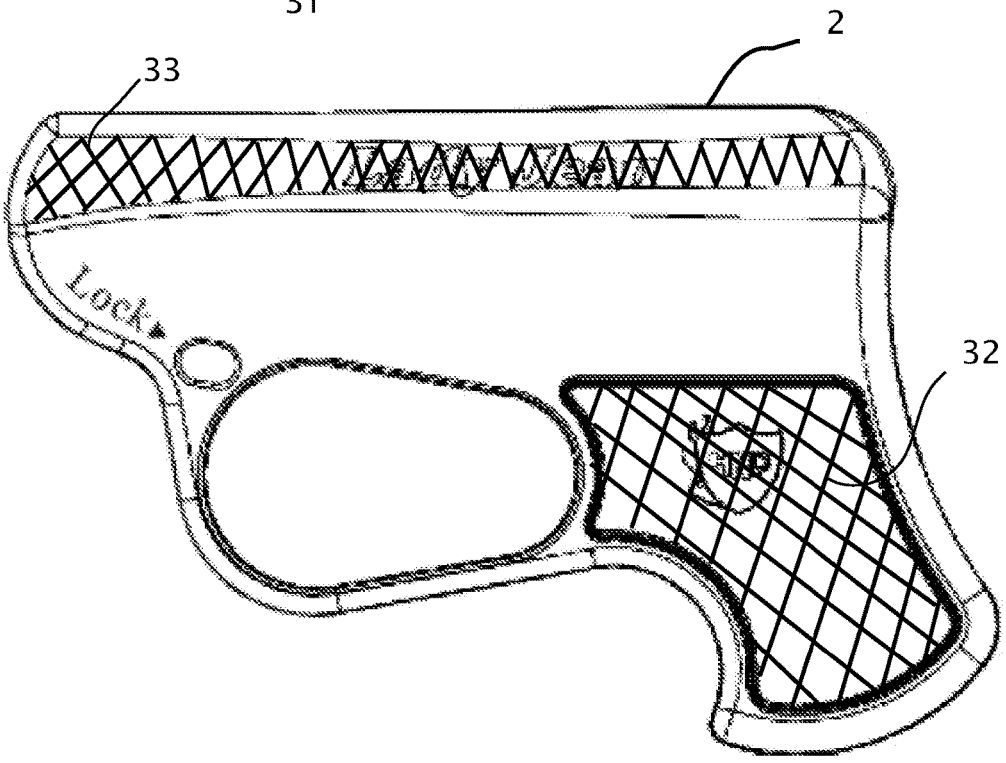

Reference is now made to FIG. 3D and to FIG. 3E which illustrate side views of housings 1 and 2 respectively, according to a feature of the present invention. Housing 1 is shown with safety guard 9 and spring 8. Housings 1 and 2 are shown with respective textures 31 and 32 on the handle of weapon 10. Textures 31 and 32 as shown provide the function of extra grip to the handle of weapon 10 and/or a cosmetic feature. Textures 31 and 32 may be formed as part of the casting process of housings 1 and 2. Similar textures to textures 31 and 32 may also be applied on different surfaces of weapon 10 to facilitate grip and/or to provide a different cosmetic feature to weapon 10. FIGS. 3D and 3E show texture 33 applied to the upper surface of housings 1 and 2 respectively. Housings 1 and 2 may be cast without textures 31, 32 and/or textures 33 as shown in previous FIGS. 1, 3A and 3C.

Figure 4A:
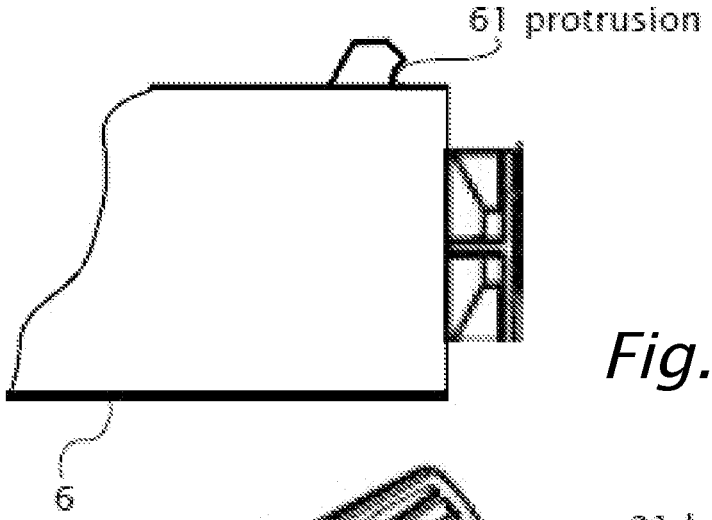
FIG. 4A shows a partial drawing of a barrel with protrusion, according to a feature of the present invention.
Figure 4B:
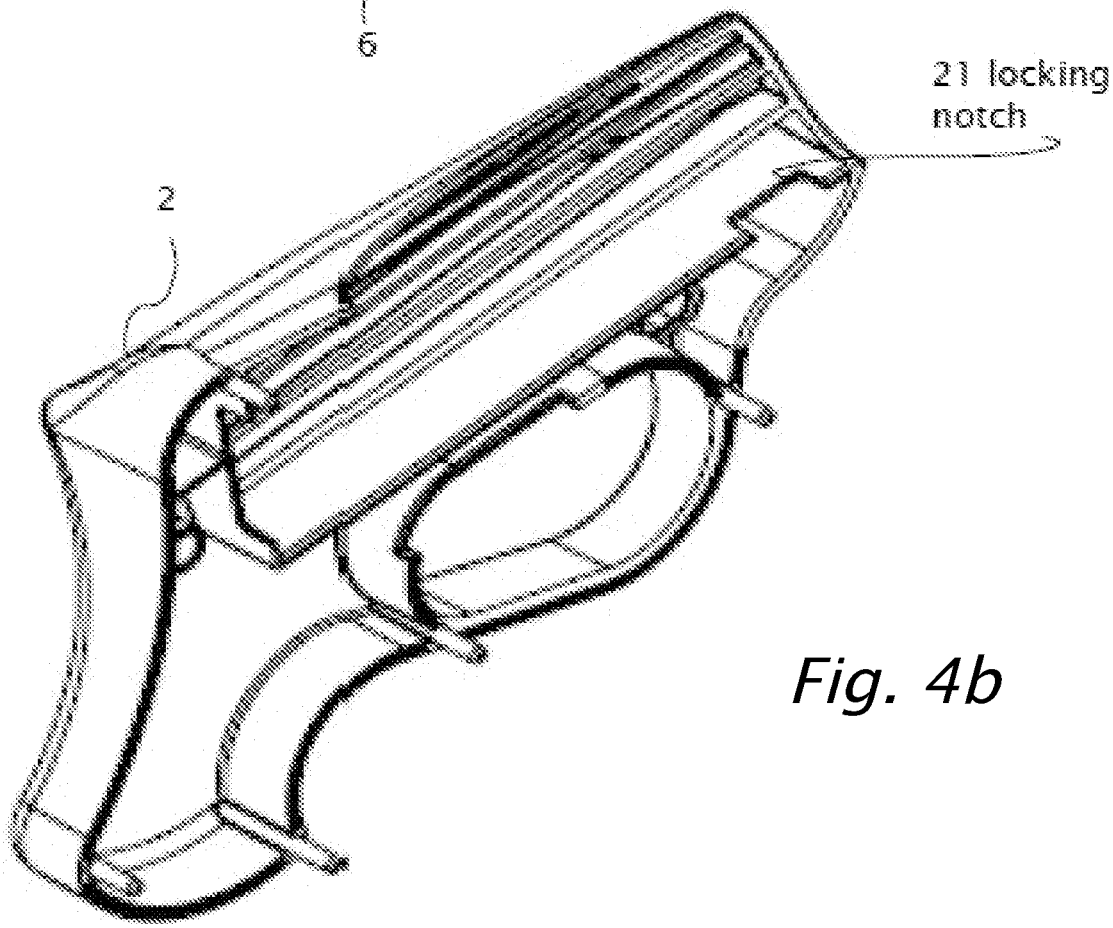
FIG. 4B shows a housing and locking notch, according to a feature of the present invention.
Figure 4C:
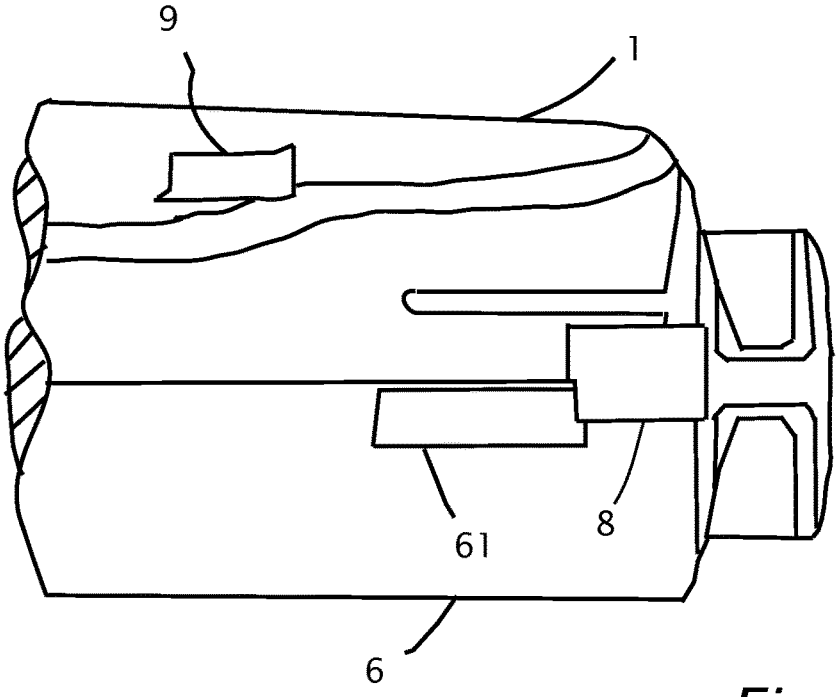
FIG. 4C shows a partial drawing of a barrel and a housing, according to a feature of the present invention.
Figure 4D:
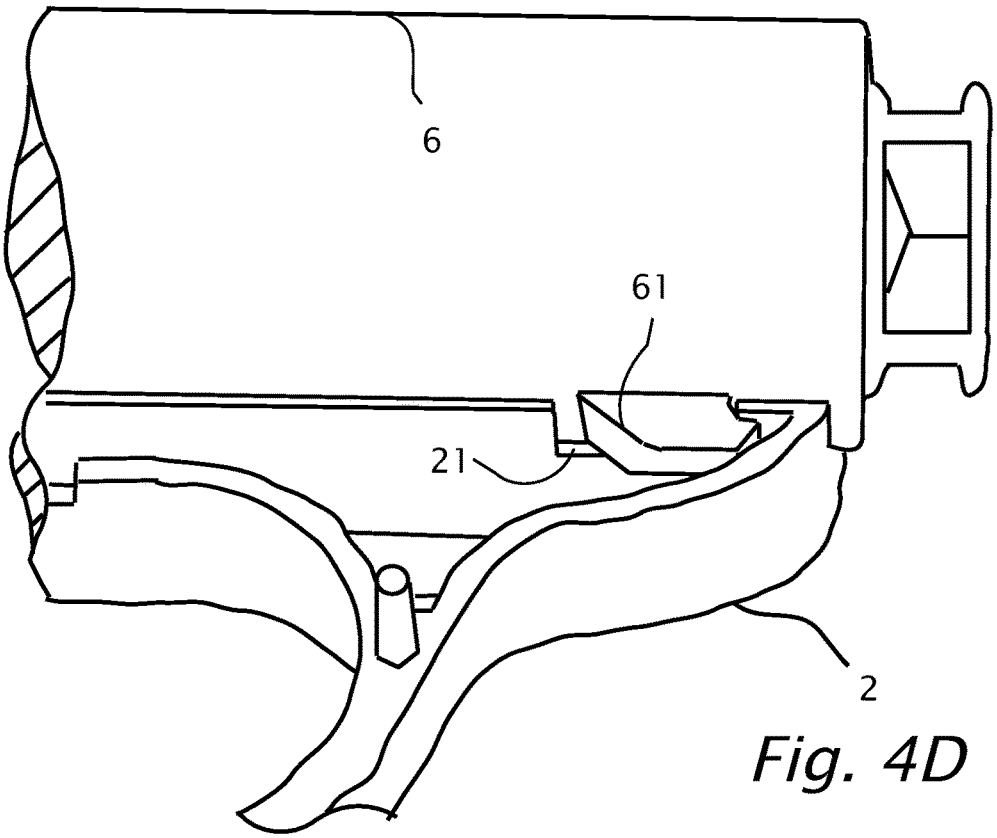
FIG. 4D illustrates a partial drawing of an insertion of a barrel and locking of the barrel into a housing, according to a feature of the present invention.

Reference is now made to FIGS. 4A, 4B, 4C and 4D which illustrate insertion of barrel 6 with canister 7 and locking of barrel 6 into housings 1 and 2, according to a feature of the present invention. FIG. 4A illustrates a side view of a portion of barrel 6 and protrusion 61 which is attached to barrel 6. On insertion of barrel 6 into housings 1 and 2 assembled, spring 8 engages protrusion 61 in barrel 6. FIG. 4B illustrates an isometric view of right housing 1 in which a locking notch 21 is shown. Locking notch 21 is engaged by protrusion 61 by rotating barrel 6 clockwise within housings 1 and 2. FIG. 4C illustrates a portion of barrel 6 from below where can be seen safety guard 9 on housing 1 and spring 8 which is a part of housing 1. FIG. 4D illustrates notch 21 of housing 2 occupied by protrusion 61 of barrel 6.

The method of insertion of canister 7 into non-lethal weapon 10 includes the following steps: Canister 7 is inserted into barrel 6, barrel 6 holding canister 7 is inserted into housings 1 and 2 until spring 8 engages protrusion 61 so that further insertion of barrel 6 causes protrusion 61 to pass under spring 8. Once protrusion 61 has passed under spring 8, barrel 6 is then rotated inside housings 1 and 2 until protrusion 61 of barrel 6 engages notch 21 of housing 2. Therefore, the method as described shows a barrel locking mechanism for barrel 6 by virtue of protrusion 61 of barrel 6 being held by spring 8 of housing 1 and rotationally engaging notch 21 of housing 2.

For convenience of description and not with intent to profile, the attacker or perpetrator is assumed to be male and the victim or attacked individual is assumed to be female Capsaicin, the active component of chili peppers belongs to the genus Capsicum. Capsaicin is an irritant for mammals including humans. The term "pepper extract" as used herein includes capsaicin and related compounds capsaicinoids including (but not limited by) dihydrocapsaicin, nordihydrocapsaicin, homodihydrocapsaicin, homocapsaicin, and nonivamide. The term "pepper extract" as used herein includes chemicals which are natural and extracted from peppers for instance and/or similar chemicals which may be synthesized.

The terms "cartridge" and "barrel" are used herein interchangeably.

The terms "canister" and "bottle" are used herein interchangeably and both terms refer to a high-pressure container storing the pepper extract used in the device of the present invention.

The indefinite articles "a", "an" as used herein, such as "a housing", has the meaning of "one or more" that is "one or more housings".

Although selected features of the present invention have been shown and described, it is to be understood the present invention is not limited to the described features. Instead, it is to be appreciated that changes may be made to these features without departing from the principles and spirit of the invention, the scope of which is defined by the claims and the equivalents thereof.

What is claimed is:

1. A non-lethal weapon adapted for spraying pepper extract onto a potential attacker in order to disable the potential attacker, the non-lethal weapon comprising:
- a housing;
- a barrel insertable into the housing, wherein the barrel has a longitudinal axis; and
- a conical orifice configured to spray the pepper extract over an opening angle of between 70 and 120 degrees;
- wherein an assembly of the barrel in the housing is characterized by:
- the housing including an upper surface with a curve-shaped cutout;
- the barrel inserted through the upper surface of the housing with a surface of the barrel intersecting the upper surface of the housing at the curve-shaped cutout, wherein the longitudinal axis of the barrel is angled upward at a substantial angle relative to a plane substantially including the curve-shaped cutout; and
- the assembly of the barrel in the housing and the conical orifice include a means for spraying the attacker in the face at a distance from the attacker of less than two meters, wherein the spraying is without aim or under restraint by the attacker.

2. The non-lethal weapon of claim 1, wherein said substantial angle of said barrel is between 10 and 30 degrees relative to said plane.

3. The non-lethal weapon of claim 2, wherein said substantial angle of said barrel limits the range of the non-lethal weapon to two meters.

4. The non-lethal weapon of claim 1, further comprising: a trigger mechanism for spraying pepper extract; and a safety mechanism which when engaged enables the trigger mechanism and when released disables the trigger mechanism.

5. The non-lethal weapon of claim 4, further comprising: a safety guard which protrudes from the housing around the safety mechanism to prevent an accidental release of the safety mechanism.

6. A non-lethal weapon adapted for spraying a pepper extract onto a potential attacker in order to disable the potential attacker, the non-lethal weapon comprising:
- a right housing and a left housing configured to be snapped together using a plurality of pins and corresponding holes integral to the castings of the housings;
- a barrel insertable into the housings, wherein the barrel includes a conical orifice adapted to spray the pepper extract over an opening angle of between 70 and 120 degrees;
- a safety mechanism having a locked position and an unlocked position, wherein the safety is insertable into an aperture in the housings;
- a trigger mechanism insertable into an aperture in the housings; and
- a hammer insertable into an aperture in the housings;
- when the safety mechanism is in the unlocked position, the trigger mechanism is configured to engage the hammer, wherein an assembly of the barrel in the housing is characterized by:
- the housing including an upper surface with a curve-shaped cutout;
- the barrel inserted through the upper surface the housing with a surface of the barrel intersecting the upper surface of the housing at the curve-shaped cutout, wherein the longitudinal axis of the barrel is angled upward at a substantial angle relative to a plane substantially including the curve-shaped cutout; and
- the assembly of the barrel in the housing and the conical orifice include a means for spraying the attacker in the face at a distance from the attacker of less than two meters, wherein the spraying is without aim or under restraint by the attacker.

7. The non-lethal weapon of claim 6, further comprising a barrel locking mechanism wherein the barrel is rotatable to lock the barrel into the housing.

8. The non-lethal weapon of claim 6, further comprising:
- a safety guard which protrudes from the housing around the safety mechanism to prevent an accidental release of the safety mechanism.

9. The non-lethal weapon of claim 6, wherein said substantial angle of said barrel is between 10 and 30 degrees relative to said plane.

* * * * *